US009631387B2

(12) United States Patent
Baker

(10) Patent No.: US 9,631,387 B2
(45) Date of Patent: Apr. 25, 2017

(54) APPARATUS FOR EVACUATING CONTAMINANTS AND WATER VAPOR FROM AN AREA ABOVE A SWIMMING POOL

(76) Inventor: Donald Cyrus Baker, Clover, SC (US)

( * ) Notice: Subject to any disclaimer, the term of this patent is extended or adjusted under 35 U.S.C. 154(b) by 284 days.

(21) Appl. No.: 13/152,166

(22) Filed: Jun. 2, 2011

(65) Prior Publication Data

US 2011/0244782 A1 Oct. 6, 2011

Related U.S. Application Data

(63) Continuation-in-part of application No. 12/944,438, filed on Nov. 11, 2010.

(60) Provisional application No. 61/260,057, filed on Nov. 11, 2009, provisional application No. 61/299,379, filed on Jan. 29, 2010.

(51) Int. Cl.
*E04H 4/12* (2006.01)
*F24F 13/02* (2006.01)

(52) U.S. Cl.
CPC ..... *E04H 4/1227* (2013.01); *F24F 13/0227* (2013.01)

(58) Field of Classification Search
CPC ..... F24F 7/04; F24F 7/06; F24F 7/065; F24F 7/08; F24F 7/10; F24F 13/0227; F24F 13/0254; F24F 13/0272; F24F 13/02; F24F 13/0209; E04F 17/04; A01G 9/246
USPC ..... 4/510
See application file for complete search history.

(56) References Cited

U.S. PATENT DOCUMENTS

| | | | | | |
|---|---|---|---|---|---|
| 3,057,287 | A * | 10/1962 | Gray | 454/67 | |
| 3,492,761 | A * | 2/1970 | Taylor | A01G 9/246 454/330 | |
| 3,835,606 | A * | 9/1974 | Liberman | E04B 9/02 138/149 | |
| 3,975,780 | A * | 8/1976 | Bowen et al. | 454/349 | |
| 4,080,670 | A * | 3/1978 | van den Broek | 4/510 | |
| 4,593,421 | A * | 6/1986 | Cohen | 4/507 | |
| 4,876,949 | A * | 10/1989 | Fairchild | F24F 13/06 454/296 | |
| 6,729,795 | B2 | 5/2004 | Dahowski et al. | | |
| 7,137,155 | B2 | 11/2006 | Sugranes Arimany | | |
| 2009/0139019 | A1 | 6/2009 | Shebek et al. | | |
| 2009/0183453 | A1* | 7/2009 | Koessler et al. | 52/302.3 | |

OTHER PUBLICATIONS

Stottmeister et al.; "Managing Trichloramine in Indoor Pools"; Institute of Sport and Recreation Management; Jan. 2009; Ref-349, Loughborough, UK, pp. 1-5.

(Continued)

*Primary Examiner* — Janie Loeppke
(74) *Attorney, Agent, or Firm* — Meunier Carlin & Curfman LLC

(57) ABSTRACT

An apparatus captures and evacuates air from an area above a body of liquid, particularly a swimming pool. The apparatus exhausts the contaminants and water vapor to an area outside of an enclosure housing the swimming pool. The invention comprises an assembly mounted to a wall adjacent the body of liquid. The assembly is comprised of a top section, opposing side sections connected by the top section, and at least one flange extending from an edge of at least one side section. The wall-mounted and bench assembly may be formed integrally, but also may be formed from two or more pieces.

11 Claims, 16 Drawing Sheets

(56) References Cited

OTHER PUBLICATIONS

International Facility Management Association; "Property Manager Has a Better Idea for HVAC Ductwork and IAQ at YMCA Indoor Pool"; downloaded from www.ifma.org/daily_articles/2007/jun06_08.cfm, Nov. 11, 2010, pp. 1-2.
Lightcap et al.; "Breaking Point"; Michigan Pool News; May 2009; downloaded from www.michiganpoolnews.com/2009/05/breaking-point/, Nov. 11, 2010, pp. 1-3.
Dryden Aqua; "Relationship between Mono Di and trichloramine"; Active Water Treatment sustainable technology; downloaded from www.afm.eu/applications/afm_swimming/, Nov. 11, 2010, pp. 1-4.

* cited by examiner

POOL PLAN

NOTE SYSTEM TO BE INTEGRATED WITH HVAC SYTTEM

POOL CHLORAMINE EVACUATION SYSTEM

POOL WALL ISOMETRIC WITH CANTILEVERD DECK

POOL WALL ISOMETRIC WITH DECK LEVEL SYSTEM

POOL WALL SECTION
WITH DECK LEVEL SYSTEM

ENLARGED PERIMETER
PLENUM

APPARATUS FOR EVACUATING CONTAMINANTS AND WATER VAPOR FROM AN AREA ABOVE A SWIMMING POOL

CROSS-REFERENCE TO PRIORITY APPLICATIONS

This application is a continuation-in-part of U.S. patent application Ser. No. 12/944,438 filed Nov. 11, 2010, in the U.S. Patent and Trademark Office, and claims the benefit of and priority to U.S. Provisional Patent Application Ser. No. 61/260,057, filed Nov. 11, 2009, in the U.S. Patent and Trademark Office, and U.S. Provisional Patent Application Ser. No. 61/299,379, filed Jan. 29, 2010, in the U.S. Patent and Trademark Office. This application incorporates the earlier provisional applications by reference in their entirety.

BACKGROUND OF THE INVENTION

The invention relates to an apparatus for evacuating air from an area above a body of liquid, and in particular an apparatus for evacuating contaminants and water vapor from an area above a swimming pool and exhausting the contaminants and water vapor to an area outside of an enclosure housing the swimming pool. The invention also provides a method for evacuating contaminants and water vapor from an enclosure housing a swimming pool.

In one embodiment of the invention comprises a perimeter drain assembly extending around the swimming pool, at least one conduit in communication with a channel defined by the drain assembly, at least one port in the conduit for directing air, at least one port in the conduit for directing liquid, at least one exhaust conduit, and at least one exhaust apparatus for drawing and directing the contaminants and water vapor to a desired area separate and apart from the swimming pool enclosure or facility.

In another embodiment, the invention provides a method for evacuating contaminants and water vapor from an enclosure housing a swimming pool comprising the steps of directing a flow of air against and/or across the surface of a swimming pool, creating a zone of containment for contaminants and water vapor substantially above the swimming pool, and evacuating the contaminants and water vapor across the pool surface into at least one port defined by the conduit and into an exhaust system.

The chemicals used to treat water in a swimming pool create contaminants that may be harmful to swimmers and others present within an enclosure housing a swimming pool (e.g., a natatorium). The water in the swimming pool also creates water vapor (i.e., humidity) within the swimming pool facility. The contaminants (e.g., chloramine) can irritate the eyes and air passages of individuals in and around the pool area. The contaminants such as chloramine are present in the air within the swimming pool enclosure, but are concentrated in an area immediately above the surface of the swimming pool. Unfortunately, greater amounts of chloramine are created when the swimming pool is in use due to swimmers agitating the water (e.g., swimming and splashing). Moreover, the high humidity within the enclosure creates an uncomfortable environment for individuals and can affect the physical structure (e.g., girders and roofing) forming the enclosure (e.g., corrosion).

Moreover, the high humidity formed within the enclosure housing a swimming pool requires that a heating, ventilating, and air conditioning (HVAC) system run almost continuously to circulate and dehumidify the air contained within the enclosure. In addition, the HVAC system runs nearly continuously to circulate the air in order to avoid high concentrations of contaminants in the air.

It is desirable therefore to reduce the levels of contaminants and humidity within the enclosure housing a swimming pool. Moreover, it is desirable for swimming pool facilities to improve the efficiency of the HVAC system in order to reduce costs associated with circulating, filtering, and dehumidifying the air within the swimming pool facility.

Accordingly, the present invention addresses the requirements for an energy-efficient apparatus and method for evacuating contaminants and water vapor from a swimming pool facility.

SUMMARY OF THE INVENTION

The invention comprises in one embodiment a perimeter deck drain assembly extending around the swimming pool, at least one conduit in communication with a channel defined by the deck drain assembly, at least one port defined by the conduit for directing air, at least one port defined by the conduit for directing liquid, at least one exhaust conduit, and at least one exhaust apparatus for drawing and directing the contaminants and water vapor to a desired area separate and apart from the swimming pool facility. The evacuation system may include bench seating with ports for positioning adjacent the surface of a pool and for receiving air flow therein that can be directed to an appropriate exhaust system.

In another embodiment, the invention provides a method for evacuating contaminants and water vapor from an enclosure housing a swimming pool comprising the steps of directing a flow of air against the surface of a swimming pool, creating a zone of containment for contaminants and water vapor substantially above the swimming pool, and evacuating the contaminants and water vapor across the pool surface into at least one port defined by the conduit and into an exhaust system.

In yet another embodiment, the invention comprises an assembly mounted to a wall adjacent the body of liquid. The assembly is comprised of a top section, opposing side sections connected by the top section, and at least one flange extending from an edge of at least one side section. The assembly also includes at least one port connected to a conduit wherein the port directs contaminants and water vapor from a surface of the body of liquid into said conduit, and the conduit evacuates the contaminants and water vapor from the body of liquid. The flange may secure the assembly to a wall adjacent the body of liquid. The flange may include at least one opening for securing the assembly to the wall.

In another embodiment, the wall-mounted assembly or the bench assembly is a two-piece or three-piece assembly. Specifically, the assemblies may include two or more side sections and top sections.

BRIEF DESCRIPTION OF THE DRAWINGS

The foregoing and other objects and advantages of the invention and the manner in which the same are accomplished will become clearer based on the following detailed description taken in conjunction with the accompanying drawing in which various embodiments of the invention are depicted.

DETAILED DESCRIPTION OF THE INVENTION

Figure 1:
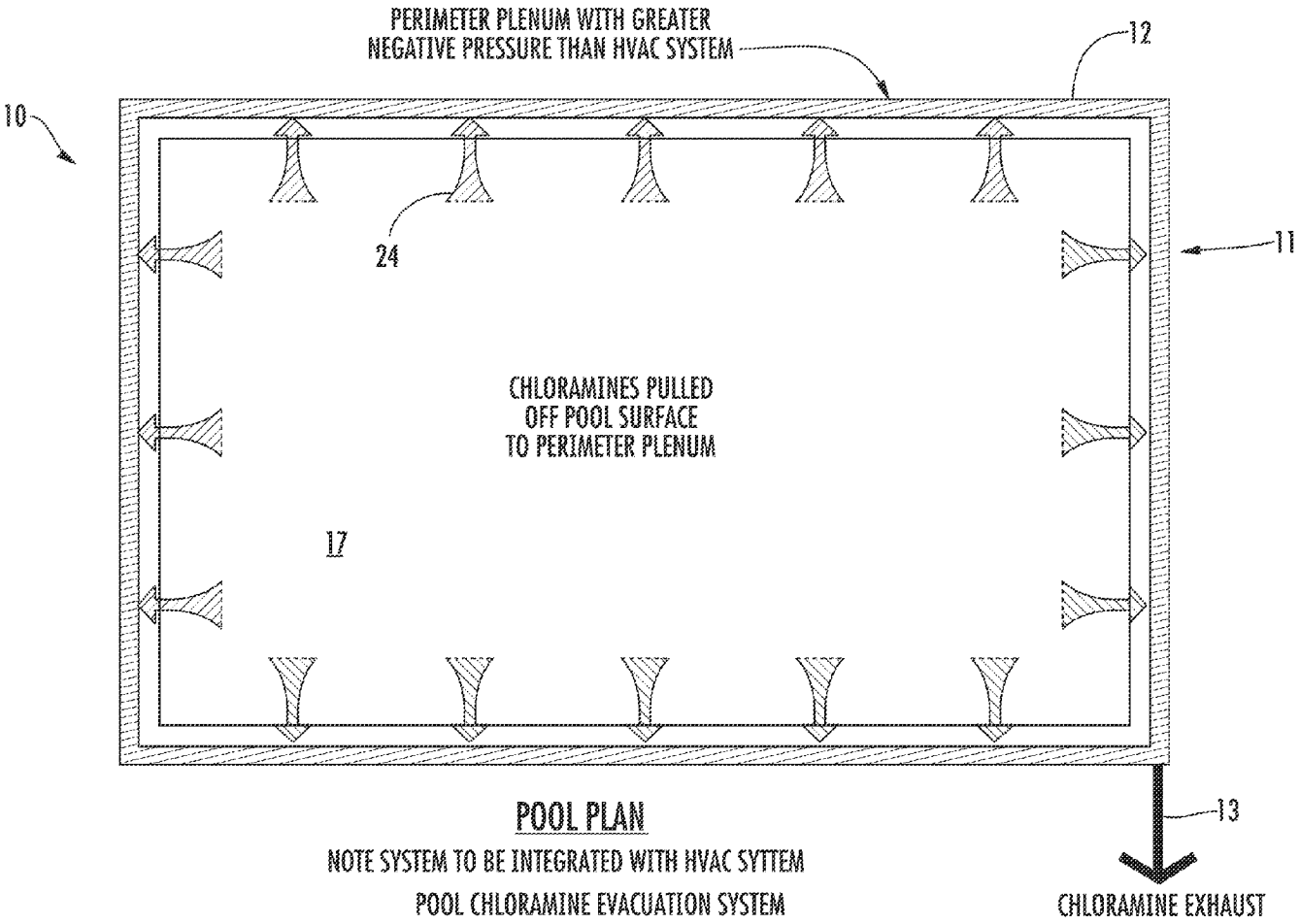
FIG. 1 is a top plan view of one embodiment of the invention.

The present invention will now be described more fully hereinafter with reference to the accompanying drawings, in which a preferred embodiment of the invention is shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

The invention 10 comprises in one embodiment a perimeter deck drain assembly 11 extending around a body of water (e.g., swimming pool 17), at least one conduit 12 positioned substantially adjacent to the deck drain assembly, at least one exhaust conduit 13 for evacuating contaminants and water vapor, and at least one exhaust apparatus 14 for drawing and directing the contaminants and water vapor to a desired area. The embodiments of the invention disclosed herein are adapted to be integrated with an HVAC system associated with standard swimming pool construction as well as standard chloramines evacuation systems.

Figure 3:
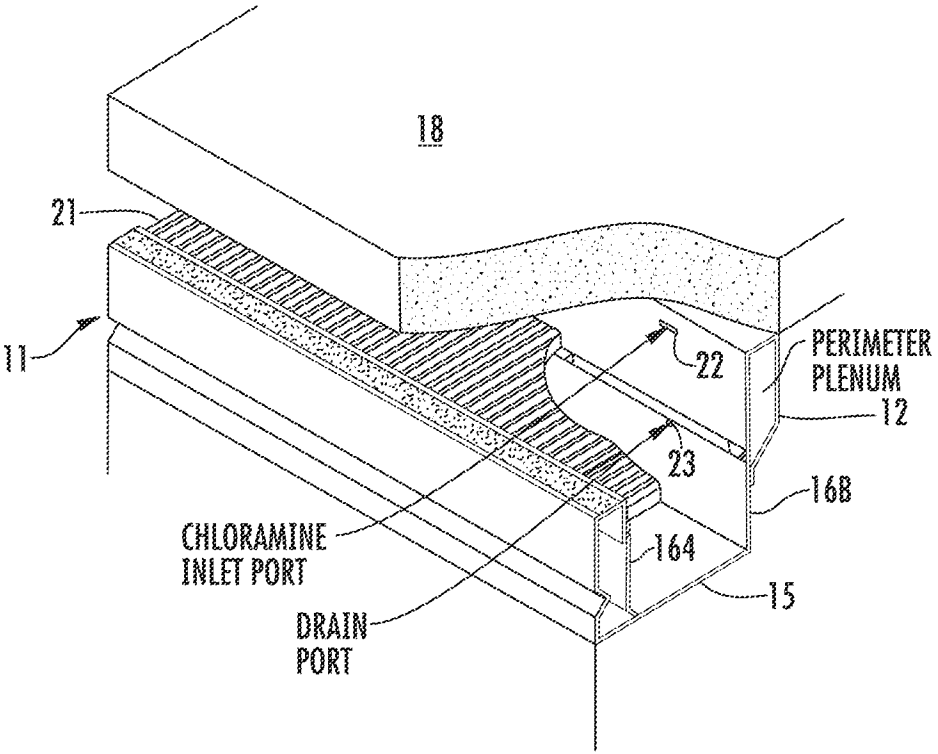
FIG. 3 is a partial perspective view of one embodiment of the invention.

As shown in FIGS. 1 and 3 the deck drain assembly extends around the swimming pool and includes a bottom panel 15 and two side panels 16A, 16B extending vertically from opposing edges of the bottom panel. The deck drain assembly defines a channel 20 for collecting and circulating liquid (e.g., pool water). A grate or grate sections 21 may cover the channel. The gutter assembly may be formed from any number of materials suitable for pool construction such as concrete, stainless, polyvinyl chloride (PVC), fiberglass, or tile.

The conduit 12 is in communication with the channel 20 and is positioned substantially adjacent thereto. For example, in one embodiment the conduit 12 is secured to one of the side panels 16A, 16B opposite the side panel adjacent to the pool. Stated differently, the conduit 12 may be secured to a back side panel of the deck drain assembly. In one embodiment, the conduit is positioned slightly above the side panels.

It will be understood that the conduit may be formed from any number of materials suitable for construction in connection with swimming pools. For example, the conduit 12 may be formed from polyvinyl chloride (PVC), stainless steel or concrete.

The conduit 12 defines at least one port 22 for directing air and at least one port 23 for directing liquid. It will be understood that any number of ports for directing air and fluid (e.g., water) may be positioned about the conduit and perimeter deck drain assembly. Moreover, the ports 22, 23 for directing air and water may be of varying sizes depending upon the size of the swimming pool and pool facility, and requirements to create a uniform draw to properly evacuate contaminants and water vapor. Depending upon the pool structure, the ports may be formed in the PVC, stainless steel, or concrete forming the perimeter gutter assembly.

Advantageously, the conduit 12 evacuates contaminants and water vapor suspended above a body of liquid (e.g., swimming pool) when a flow of air 24 traveling across the pool surface enters the channel 20 of the perimeter deck drain assembly and the ports 22 for directing air.

Figure 10:
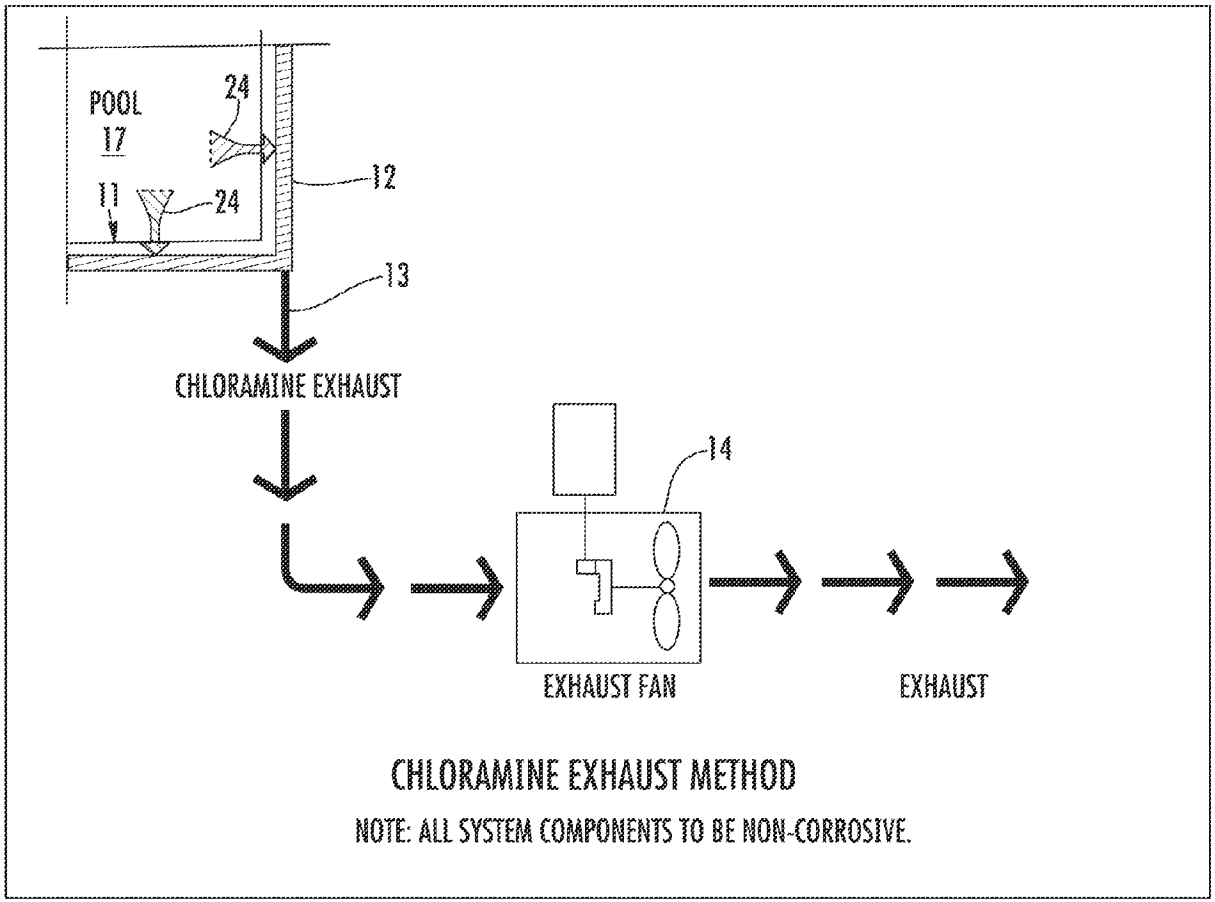
FIG. 10 is a schematic view of one embodiment of the invention.

As shown in FIG. 10 the exhaust conduit 13 for evacuating the contaminants and water vapor is in communication with the conduit 12. As illustrated in FIG. 10 the exhaust apparatus 14 draws and directs the contaminants and water vapor to a desired area spaced apart from the swimming pool (e.g., an exhaust vent outside of the swimming pool facility).

In one embodiment depicted in FIGS. 4*a*, 4*b*, 6*a*, and 6*b* the port for directing air 22 is positioned above the port for directing liquid 23. As configured, the port for directing air 22 receives flowing air that is drawn from across the pool surface and into the channel 20 defined by the perimeter deck drain assembly. The port for directing air 22 is positioned above the pool surface and is capable of receiving the flowing air containing contaminants and water vapor from the pool surface as well as from the surface of any water collected in the channel 20. Stated differently, the uniform draw of flowing air from the pool surface necessarily draws contaminants and water vapor from water collected in the channel 20 of the perimeter deck drain assembly (see FIGS. 4*a* and 6*a*).

Figure 4B:
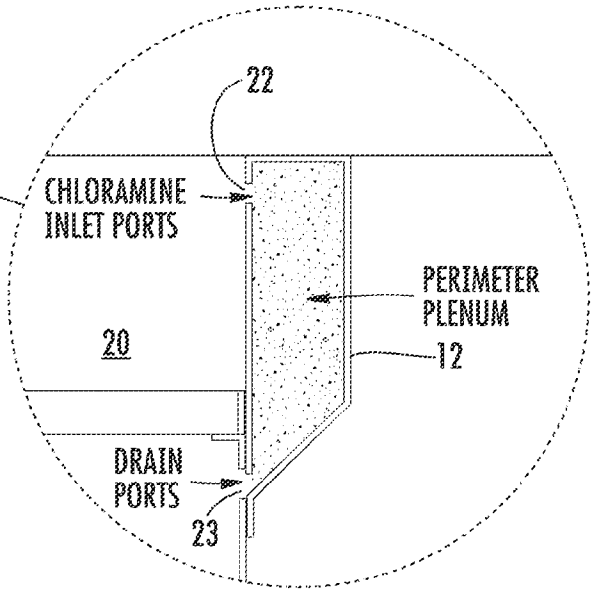
FIG. 4*b* is a partial enlarged view of the embodiment of the invention depicted in FIG. 4*a;*
Figure 4A:
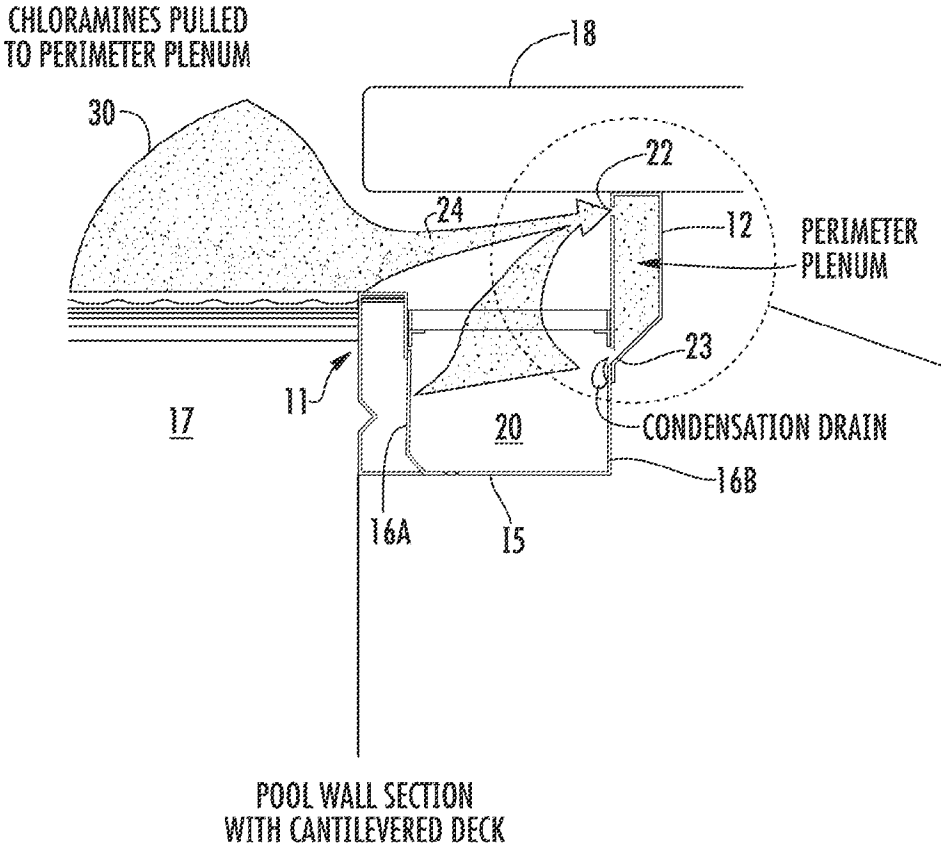
FIG. 4*a* is a cross-sectional side view of one embodiment of the invention.

In one embodiment, the port for directing air 22 and the port for directing liquid 23 are substantially coplanar with respect to one another (see FIGS. 3 and 4*a*). In other words, the two ports 22, 23 are formed in the conduit 12 and back panel 16B of the perimeter deck drain assembly. This particular embodiment is configured for deck drain assemblies wherein a portion of the pool deck 18 extends over the channel of the gutter assembly.

Figure 5:
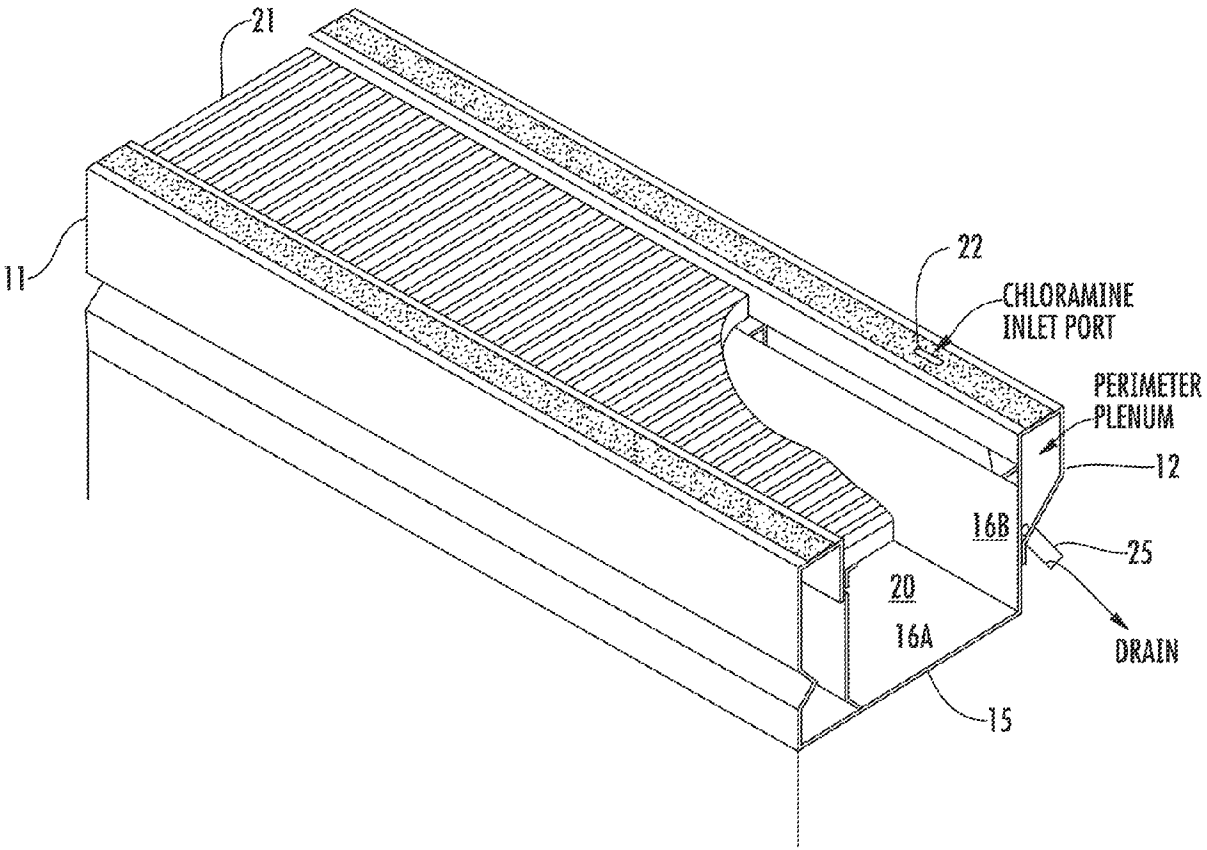
FIG. 5 is a partial perspective view of one embodiment of the invention.
Figures 6A, 6B:
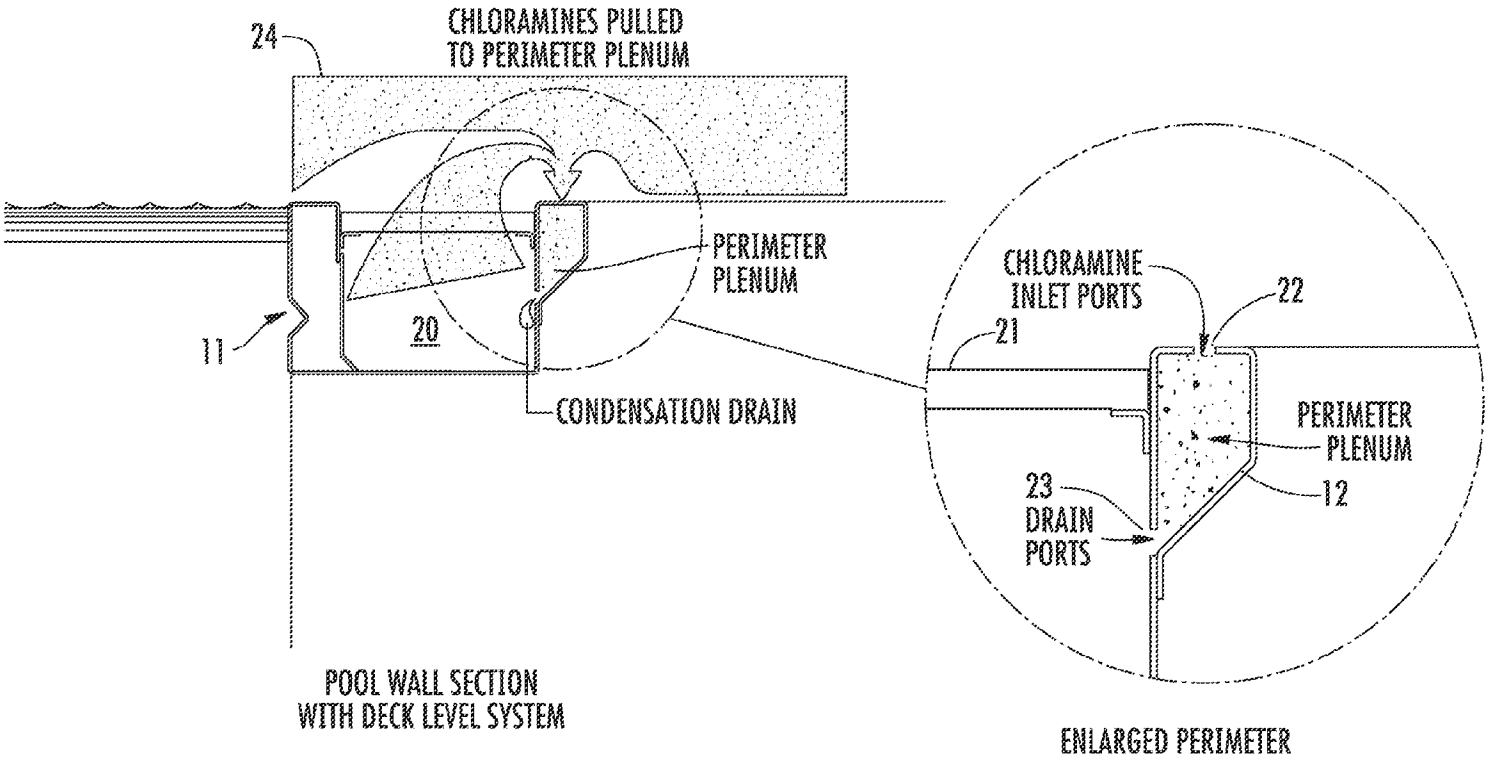
FIG. 6*a* is a cross-sectional side view of one embodiment of the invention.
FIG. 6*b* is a partial enlarged view of the embodiment of the invention depicted in FIG. 6*a;*

In another embodiment, the port for directing air 22 and the port for directing liquid 23 are substantially perpendicular with respect to one another (see FIGS. 5 and 6*a*). Stated differently, the port for directing air 22 is coplanar with the pool deck 18 and flowing air containing contaminants and water vapor is drawn through the top of the conduit. This particular embodiment is configured for perimeter gutter assemblies wherein the pool deck 18 is flush or coplanar with the deck drain assembly.

Figures 7A, 7B:
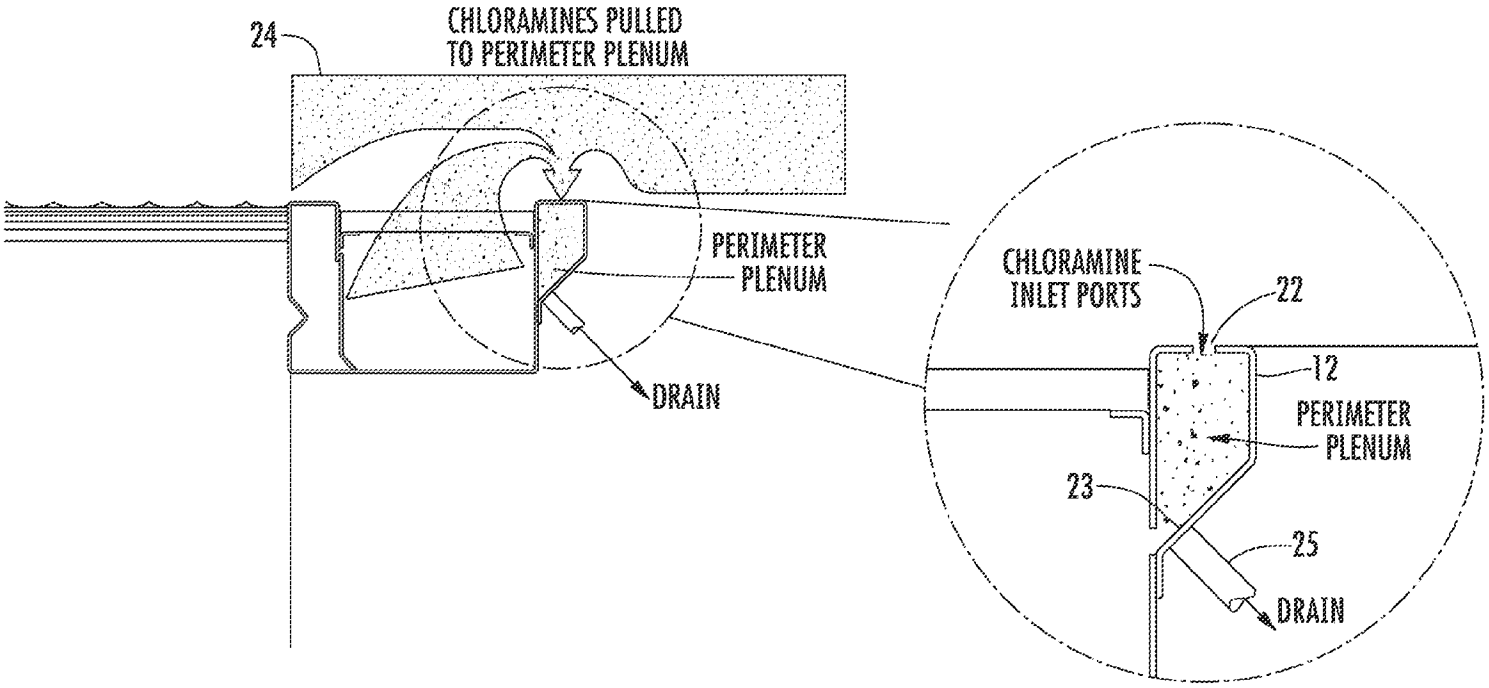
FIG. 7*a* is a cross-sectional side view of one embodiment of the invention.
FIG. 7*b* is a partial enlarged view of the embodiment of the invention depicted in FIG. 7*a;*

As shown in FIGS. 4*a* and 6*a*, the port for directing liquid 23 directs condensed water vapor into the channel. In another embodiment shown in FIGS. 5 and 7*a*, the port for directing liquid 23 directs condensed water vapor away from the channel, for example, into a drain 25. Advantageously, this configuration provides a self-draining feature to the conduit.

Figure 8:
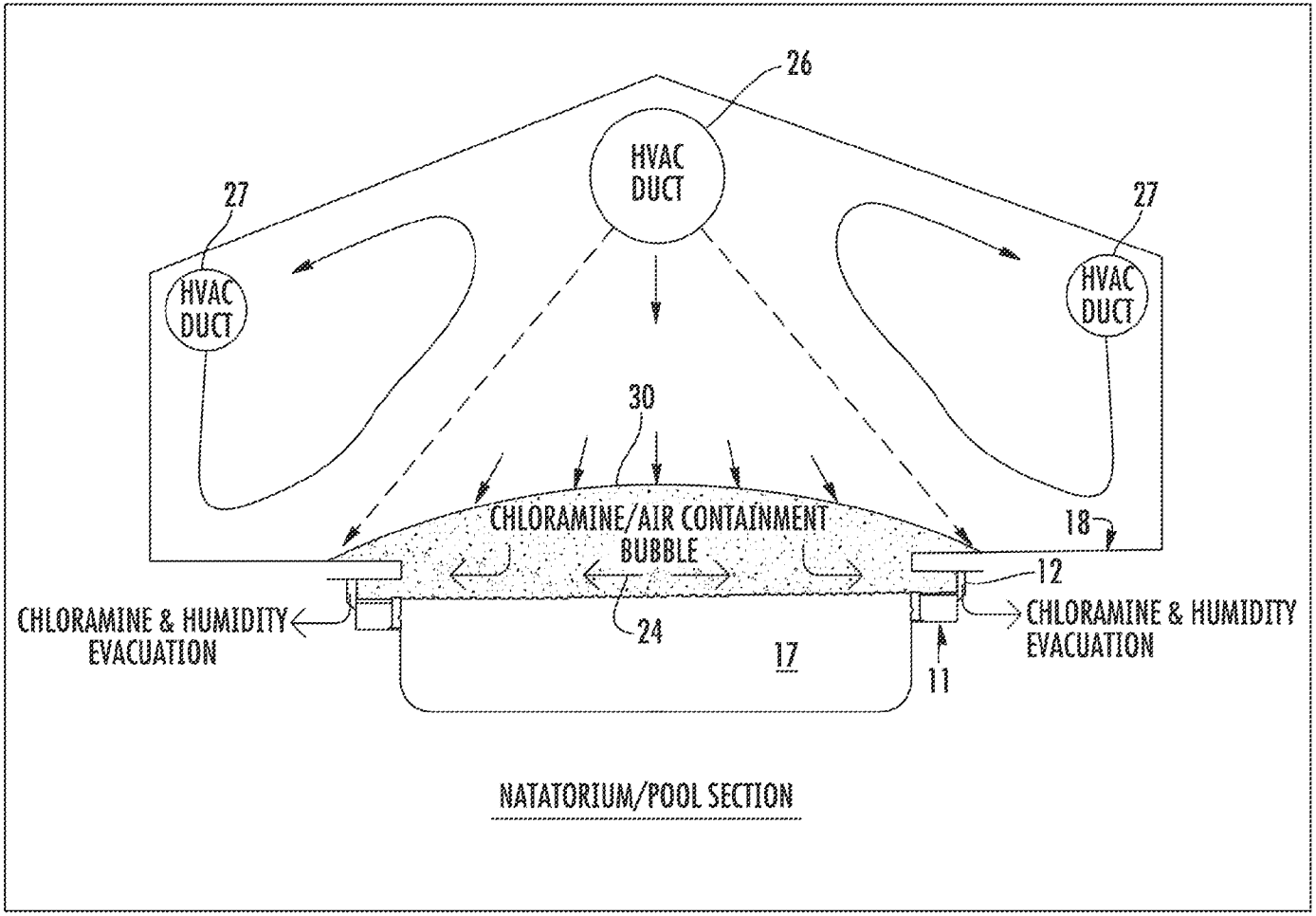
FIG. 8 is a schematic view of one embodiment of the invention.

The invention may further include at least one air source 26 for directing a flow of air downward against the surface of the swimming pool 17 as depicted in FIG. 8. As discussed below, it will be understood that one or more air sources may be incorporated into the subject invention to ensure proper evacuation of contaminants and water vapor, and sufficient recirculation of clean air (i.e., air containing minimal amounts of contaminants and water vapor). In one embodiment, one air source 26 (e.g., HVAC duct) is positioned above the swimming pool 17 in a central location with respect to the pool.

In operation, the flowing air from the air source 26 creates a zone 30 for containing contaminants and water vapor substantially above and adjacent to the pool surface (see FIG. 8). The flowing air creates overpressure above the swimming pool surface and forms the containment zone. It is understood that the air above the pool surface containing contaminants and water vapor is denser than the air emanating from the air source. Advantageously, the flowing air directs contaminants and water vapor from the containment zone 30 across the pool surface and through the conduit 12 into the port for directing air 22 to the exhaust conduit 13. In this particular embodiment depicted in FIG. 8, the central location of the air source 26 and the exhaust system draws the air containing contaminants and water vapor across the pool surface in multiple directions in a uniform draw and into the conduit 12 for evacuation by the exhaust system.

Figure 9:
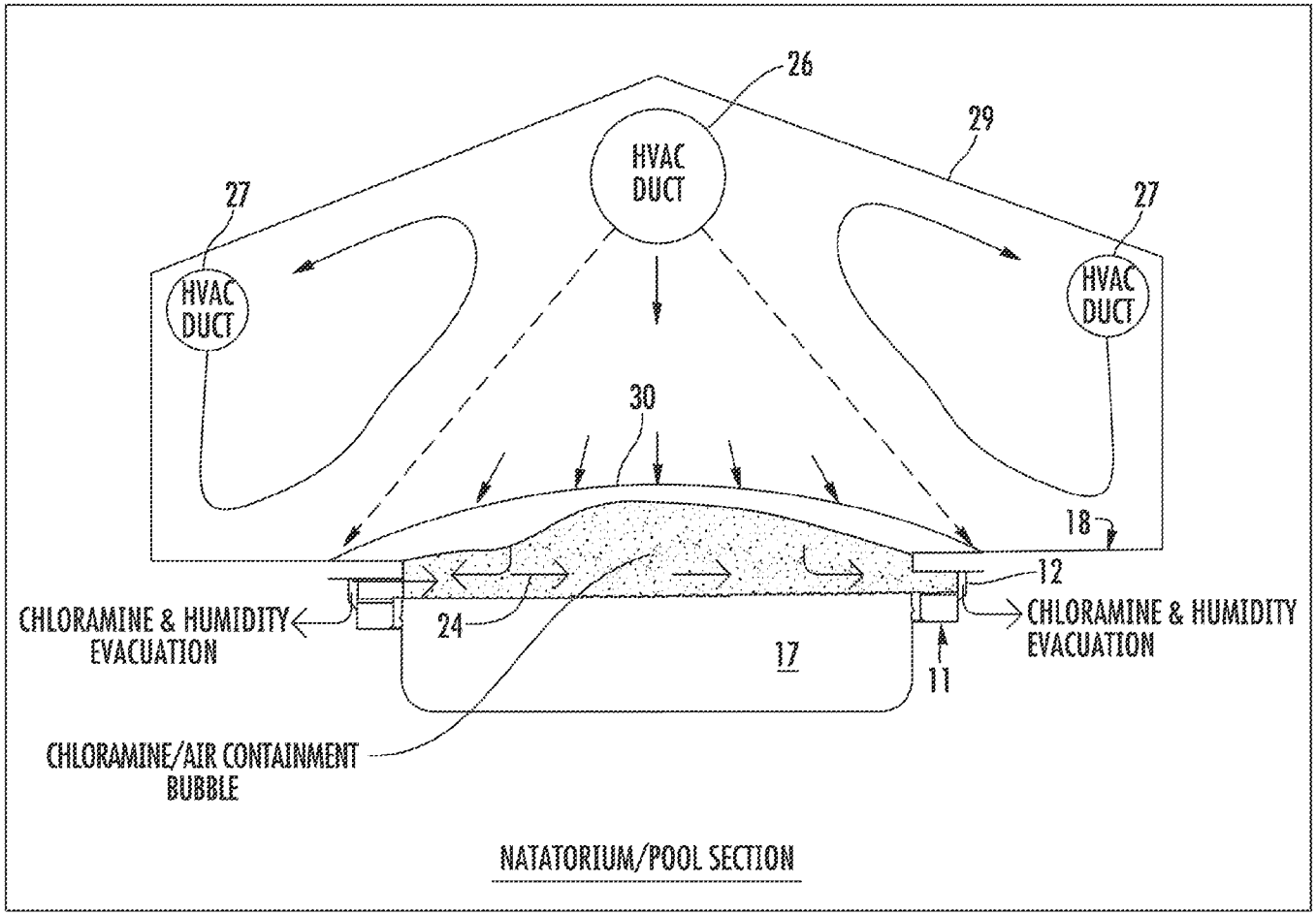
FIG. 9 is a schematic view of one embodiment of the invention.

The invention may also include one or more of additional air sources 27 for circulating a flow of air substantially adjacent to the containment zone 30 as depicted in FIGS. 8 and 9. The additional air sources 27 may be positioned above the pool deck 18 on opposite sides of the swimming pool facility (i.e., on both sides the central air source 26 positioned directly above the swimming pool 17). As illustrated, the flowing air from the additional air sources maintains the integrity of the containment zone 30 and facilitates circulation of air substantially adjacent to the containment zone 30. By doing so, clean air containing less contaminants and water vapor than in the containment zone is circulated adjacent to the containment zone 30 and adjacent to the airflow emanating from the central air source 26, thereby minimizing contaminants and water vapor (i.e., humidity) in the areas adjacent to the swimming pool.

Advantageously, the subject invention evacuates contaminants and water vapor where it is most heavily concentrated (i.e., above the pool surface) and prevents the contaminants and water vapor from disseminating throughout the swimming pool facility. Conventional systems merely mix and recirculate air containing contaminants and water vapor continuously in an effort to reduce chloramine and humidity levels within the swimming pool facility by dilution. As configured, the present novel invention works in unison with (i.e., balanced with) the HVAC system to reduce the number of air changes per hour (ACH) throughout the entire facility required to maintain safe levels of contaminants and a comfortable level of humidity and air quality. This is accomplished by evacuating contaminants and water vapor directly from the area most affected—i.e., the air in the containment zone 30 immediately above the swimming pool surface. By focusing evacuation in the containment zone 30, fewer number of air changes are required in the areas adjacent to the containment zone. In other words, the apparatus affects an area smaller than the entire area of the facility (i.e., the area immediately above the swimming pool surface) and is capable of increasing the number of air changes per hour (ACH) within the containment zone. By doing so, the apparatus 10 reduces the number of air changes per hour (ACH) required in the areas adjacent to the containment zone.

As depicted in FIG. 9 in an alternative embodiment, the invention may also include yet another air source 28 for directing a flow of air 24 across the surface of the swimming pool 17 from one side of the pool to another. In this embodiment, the additional air source 28 directs a flow of air 24 from one port for directing air 22 to another port for directing air 22 that is positioned opposite thereto. In other words, the additional air source 28 will direct (i.e., sweep) air from one or more ports 22 on one side of a swimming pool, across the pool surface, and into one or more ports 22 on the opposite side of the swimming pool. The flowing air 24 is then directed to the exhaust conduit 13 by the exhaust apparatus 14.

The invention may also include an enclosure 31 for housing the apparatus and swimming pool.

The invention also provides a method for evacuating contaminants and water vapor from an enclosure 31 housing a swimming pool 17. The method includes the steps of directing a flow of air against the surface of the swimming pool, creating a zone of containment 30 for contaminants and water vapor substantially above the swimming pool, and evacuating the contaminants and water vapor across the pool surface. The contaminants and water vapor are directed into the ports 22 defined by the conduit 12 positioned substantially adjacent to the pool surface and into an exhaust system.

In summary, the present apparatus and method provides the following advantageous benefits: reduces the level of contaminants and water vapor in the entire enclosure housing a swimming pool; operates in conjunction with HVAC system to remove contaminants, reduce humidity levels in the facility and thereby improve overall air quality; decreases the amount of heat in the facility; reduces the requirement to operate dehumidifiers within the HVAC system; reduces the number of air changes per hour (ACH) required to maintain safe contaminant levels and reduce humidity within the facility; reduces tonnage (i.e., amount of airflow) required of an HVAC system to recirculate and dehumidify air, and to reduce the concentration of contaminants (e.g., chloramine) within the facility; reduces the operating costs of a HVAC system (i.e., compressor and dehumidifier); and improves energy efficiency resulting from the variable operation of the subject invention (i.e., operates during peak demand when the pool is in use and is idle during off hours when the pool is closed); operates during peak demand or upon demand dependent upon humidity levels in the facility.

Furthermore, the subject apparatus and method decreases the amount of tonnage necessary to circulate and dehumidify air in a swimming pool facility, thereby reducing the size of new enclosures for swimming pools necessary to circulate and dehumidify the air contained therein.

In addition to new construction, the apparatus 10 is also suitable for retrofit applications for existing swimming pool facilities. By retrofitting existing facilities with the novel apparatus, one may be able to reduce the number of dehumidifiers required to maintain comfortable levels of humidity, or at least minimize the operating time of existing dehumidifiers, thereby improving energy efficiency and reducing operating costs.

Figure 11A:
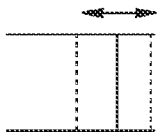
FIG. 11A is a front elevation view of the adjustable neck of FIG. 11.
Figure 11B:
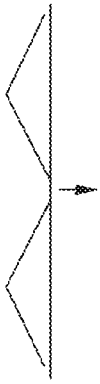
FIG. 11B shows one embodiment of the tray of FIG. 11 with multiple sloped surfaces for draining.
Figure 11:
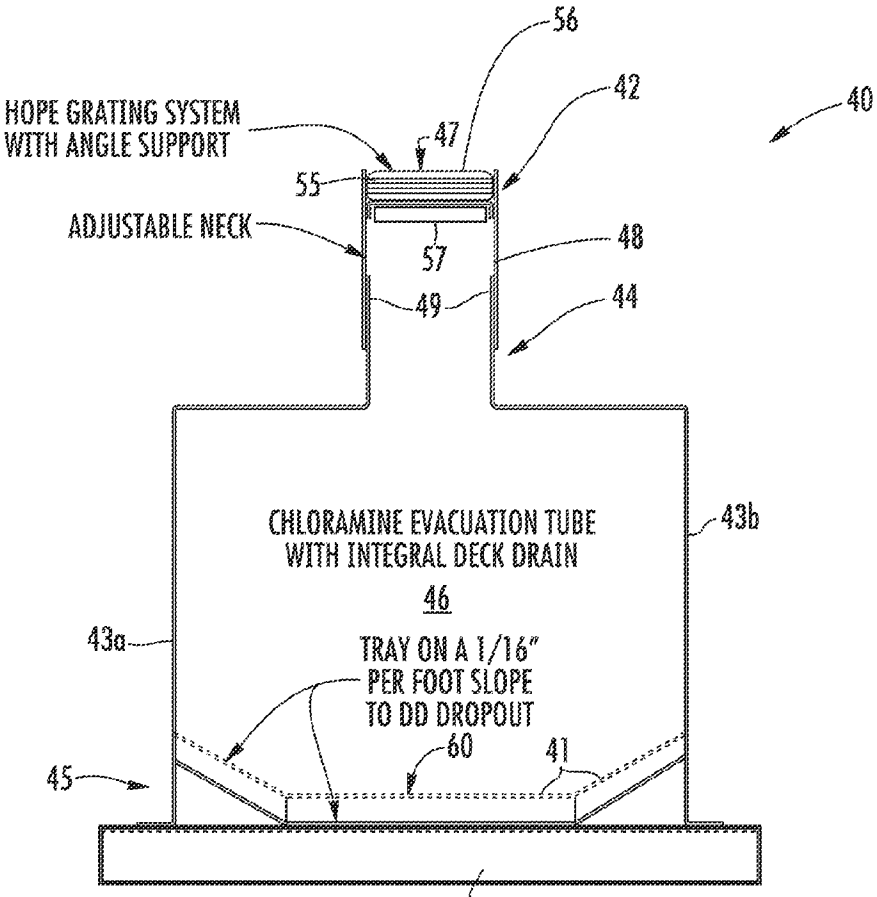
FIG. 11 is a cross-sectional side view of one embodiment of the invention.
Figure 12:
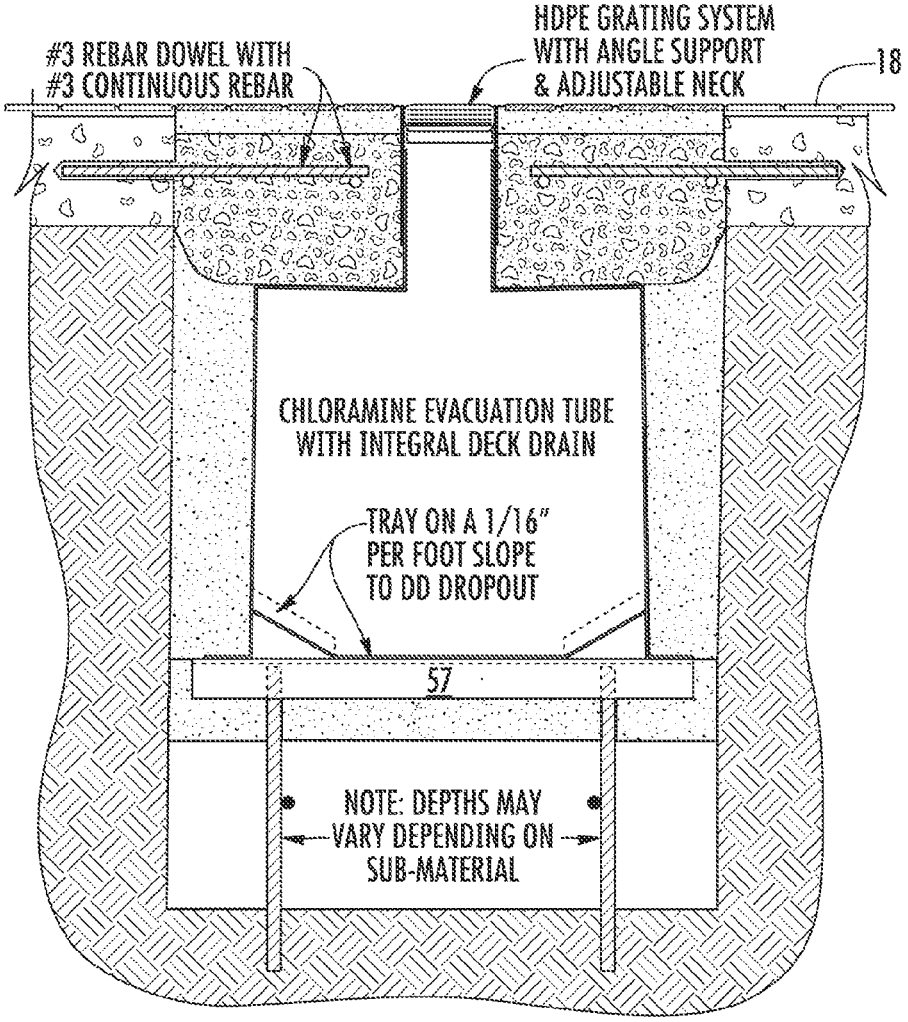
FIG. 12 is a cross-sectional side view of the embodiment of the invention shown in FIG. 11.
Figure 13:
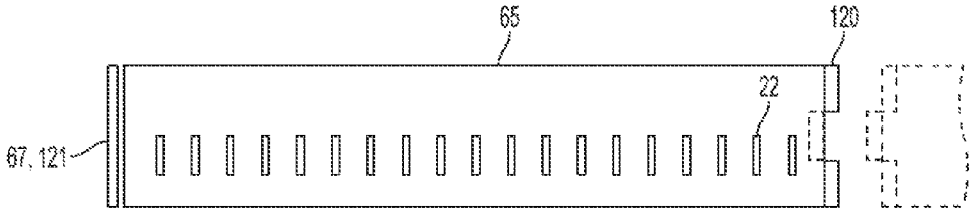
FIG. 13 is a front elevation view of an embodiment of the invention utilizing a bench with ports for ventilation.

In another embodiment set forth in FIGS. 11 and 12, the invention comprises a perimeter deck drain assembly 40 extending around at least a portion of a body of liquid (e.g., swimming pool 17), at least one tray 41 for directing liquid (e.g., water) secured to lower portions of the gutter assembly 40, and a grating system 42 for receiving water. The gutter assembly 40 has two side panels 43*a*, 43*b*, an upper section 44, and a lower section 45 all of which define at least one conduit 46 for collecting and circulating liquid. In this embodiment, the deck drain assembly 40 may be constructed substantially adjacent to the body of liquid (i.e., swimming pool). In operation, the conduit 46 evacuates contaminants and water vapor suspended above the body of liquid when a flow of air 24 traveling across the body of liquid enters the grating system 42 and conduit 46. The invention also facilitates evacuation of water vapor and contaminants formed in the conduit 46 when the water is agitated during travel. In this specific embodiment as described in detail below, the deck drain assembly 40 includes a deck drain 47 integral with the evacuation apparatus 10, wherein the deck drain 47 is flush with the deck 18 of the swimming pool 17. As shown in FIG. 11B, the tray may be shaped in any desired configuration to assist in draining and may include variously sloped surfaces.

Advantageously, the upper section 44 of the gutter assembly 40 is adjustable for height and supports the grating system 42. Specifically, the upper section 44 of the deck drain assembly 40 includes an adjustable neck 48. As shown in FIG. 1, the upper section 44 includes a four-sided section 49 having a perimeter that is slightly larger than another portion of the neck. The adjustment feature is shown schematically in FIG. 11A. As configured, the uppermost section of the neck 48 may be adjusted for height depending upon, in one embodiment, the depth of the conduit 46 and the height of a pool deck 18, and then secured to the remaining lower section 45 of the neck 48. For example, tack welds can secure the uppermost section of the neck to the remaining lower section 45 of the neck.

The tray 41 is secured to lower portions of the two side panels 43A, 43B of the deck drain assembly 40. The apparatus may include any number of trays 41 sufficient to form a bottom panel 60 of the assembly. One or more trays 41 may be sloped towards one or more drains such that water entering the grating system 42 and conduit 46 will be directed to the drain for recirculation.

The grating system 42 is positioned against the upper section 44 of the deck drain assembly 40. The grating system 42 includes at least one grate section 55 defining a plurality of openings 56 for receiving liquid or water from a swimming pool deck and a support 57 secured to the upper section 44 of the deck drain assembly 40. The support 57 releasably secures the grate sections 55 to the deck drain assembly 40. The grate sections 55 having openings 56 may be interspersed with grate sections 55 having no openings depending upon the size and shape of the swimming pool and the requirements for providing sufficient recirculation of the water.

The invention may also include at least one support member 58 for supporting the gutter assembly 40. In one embodiment, the support member 58 is secured with rebar to concrete or other material forming the swimming pool.

The invention may also include at least one exhaust conduit 13 for evacuating contaminants and water vapor, and at least one exhaust apparatus 14 for drawing and directing the contaminants and water vapor to a desired area. The exhaust conduit 13 for evacuating the contaminants and water vapor is in communication with the conduit 46 of the deck drain assembly 40. The exhaust apparatus 14 draws and directs the contaminants and water vapor to a desired area spaced apart from the swimming pool (e.g., an exhaust vent outside of the swimming pool facility).

Figure 2:
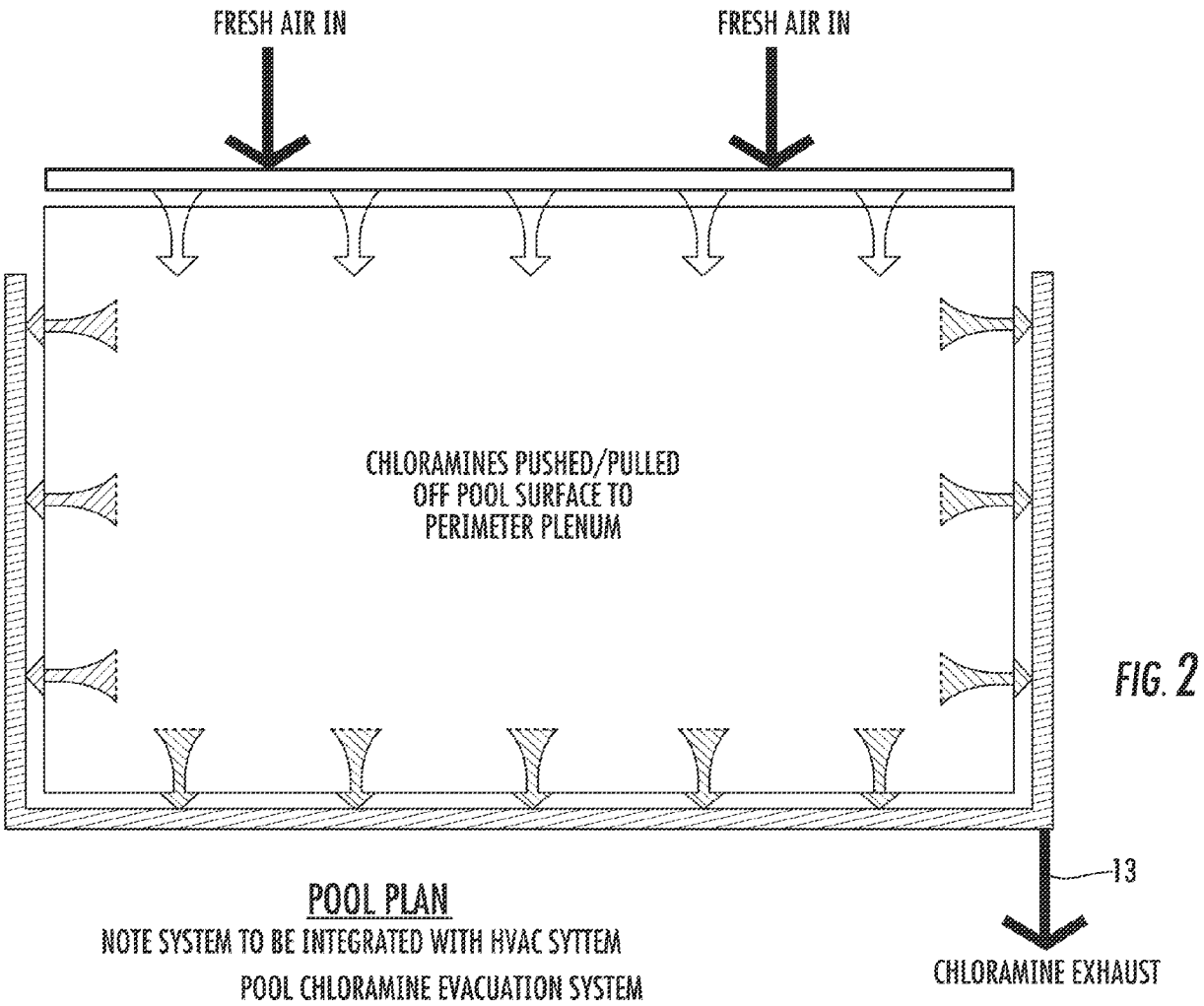
FIG. 2 is a top plan view of another embodiment of the invention.

As described earlier, at least one air source 26 for directing a flow of air against the surface of the swimming pool may be provided. In operation, the flowing air from the air source 26 creates a zone 30 for containing contaminants and water vapor substantially above the pool surface. The flowing air directs contaminants and water vapor from the containment zone 30 through the grating system 42 into the conduit 46 and to the exhaust conduit 13. As depicted in FIG. 2, the grating system 42 is flush with the deck surface 18 of the swimming pool 17.

As previously discussed, this embodiment may also include at least one air source 28 for directing a flow of air 24 across the surface of the swimming pool 17. This embodiment may further include at least another air source 27 for circulating a flow of air substantially adjacent to the containment zone 30, such that the flowing air maintains the integrity of the containment zone and facilitates circulation of air substantially adjacent to the containment zone.

This particular embodiment may also include an enclosure 31 for housing the apparatus and swimming pool.

A method incorporating this latest embodiment is also provided. The method includes the steps of directing a flow of air against and/or across the surface of the swimming pool, creating a zone of containment for contaminants and water vapor substantially above the swimming pool, and evacuating the contaminants and water vapor across the pool surface, into at least one conduit 46 positioned substantially adjacent the pool surface, and into an exhaust system.

The invention includes yet another embodiment in which the ports for evacuating contaminants and water vapor are conveniently implemented in the form of a deck bench as illustrated in FIGS. 13-17. The bench provides a seat around the perimeter of a body of liquid, such as a swimming pool. The front section 65 of the bench assembly 70 defines ports 22 that receive air flow from just above the surface of the liquid. Similar to the embodiments noted above, the ports direct contaminants and water vapor to the appropriate exhaust removal system and drainage system. Air enters a conduit defined by edges of the bench assembly 70 through the ports 22 and exits through an exhaust connector 68 to the appropriate exhaust removal and handling system.

Figure 14:
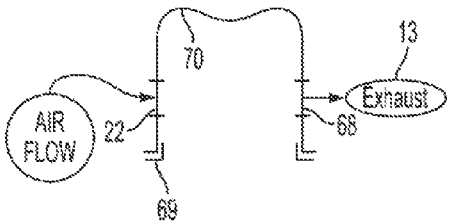
FIG. 14 is a side elevation view of the bench embodiment shown in FIG. 13.

FIG. 14 shows the air flow entering a respective port 22, and one should note that the air flow may be controlled in any of the ways described above for other embodiments of this invention so long as contaminants and water vapor efficiently enter the conduit defined by the bench assembly via the ports 22. Accordingly, the invention may further include at least one air source 26 for directing a flow of air downward against the surface of the water in a swimming pool 17 as depicted in FIG. 8 to push water vapor and contaminants into the ports 22 defined by the bench assembly 70. As discussed above, it will be understood that one or more air sources may be incorporated into the subject invention to ensure proper evacuation of contaminants and water vapor and sufficient recirculation of clean air (i.e., air containing minimal amounts of contaminants and water vapor).

Figure 15:
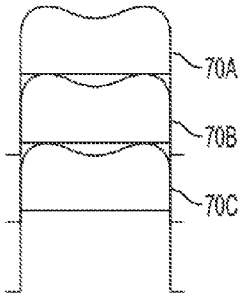
FIG. 15 is a side elevation view of the bench embodiment of FIG. 14 having modular stackable sections.
Figure 16:
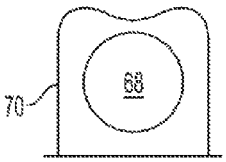
FIG. 16 is a front elevation view of the exhaust connection of the bench embodiment of FIG. 14.
Figure 17:
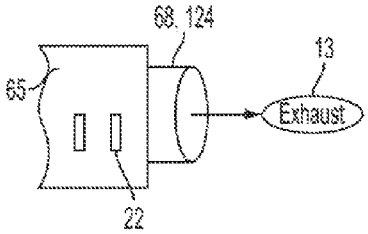
FIG. 17 is a side elevation view of the exhaust connection of FIG. 16.
Figure 20:
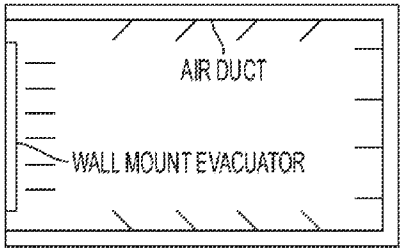
FIG. 20 is a top plan view of a body of water depicting one embodiment of the invention mounted to a wall and illustrating the overall air flow of the invention in combination with the body of liquid.

FIG. 15 shows that the bench assembly 70 may be formed of modular sections 70A, 70B, 70C for stacking and easy storage. The sections incorporate connectors (e.g., standard draw catches) that allow the sections to fit together tightly, and a gasket 67 may fit between connected sections to seal the sections together. Each section may also include a rubber foot 69 for sealing the bench assembly 70 to the floor (i.e., a floor seal). Overall, the sections 70A-70C fit to each other and to the floor adjacent a body of liquid to create an air tight enclosure that is connected to an exhaust removal system by an end piece 68 as shown in FIGS. 16 and 17. The exhaust removal system may be configured to provide a negative pressure level that actually sucks the contaminants and water vapor into the appropriate exhaust removal mechanisms.

So long as the ports 22 are accessible to the air flow above the body of liquid, the system will efficiently transport contaminants away from the liquid. The bench assembly may be sized as appropriate for the amount of contamination to be removed (e.g., sections of 16 inches by 16 inches allow for 256 square inches of air flow). The body of the bench assembly 70 and its component sections 70A-70C may comprise any materials that are convenient for manufacturing the sections and that can withstand the pressures used in the system. Bench assemblies of molded plastics or shaped metals are within the scope of the invention described herein. The number of ports 22 and the number of sections 70A-70C may be adjusted to fit the use at hand. The bench assembly may be placed in one or more regions around the body of liquid or may encompass the entire perimeter of the body of liquid.

Figure 18:
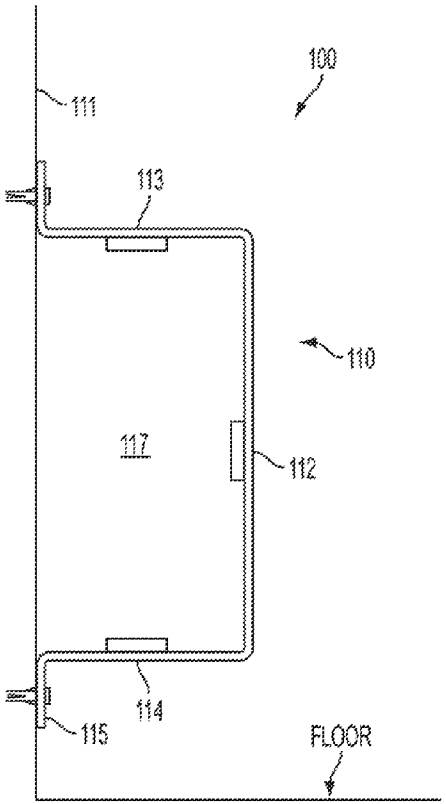
FIG. 18 is a side elevation view of another embodiment of the invention mounted to a wall.

In yet another embodiment, the invention includes a wall-mounted apparatus. More specifically, the apparatus 100 includes an assembly 110 mounted to a wall 111 adjacent the body of liquid. The assembly 110 is comprised of a top section 112, opposing side sections 113, 114 connected by the top section, and at least one flange 115 extending from an edge of at least one of the side sections. In the embodiment appearing in FIG. 18, the assembly 111 includes two flanges 115 that mount to a wall. The assembly 110 also includes at least one port 116 connected to a conduit 117, such that the port directs contaminants and water vapor from a surface of the body of liquid into the conduit, and the conduit evacuates the contaminants and water vapor from the body of liquid.

Figure 19:
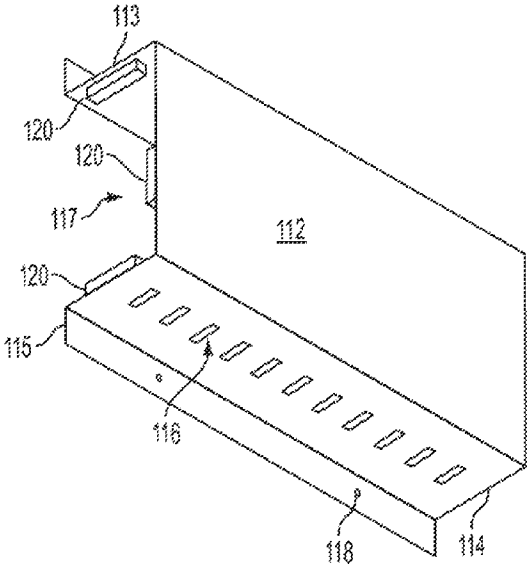
FIG. 19 is a perspective view of the wall-mounted embodiment of the invention.

In one embodiment depicted in FIG. 19, the flange(s) 115 defines at least one opening 118 for securing the assembly 110 to the wall. It will be understood that the flange 115 may not necessarily include an opening, but can be used in any number of fashions to provide a flat surface for securing the assembly 110 to a wall. In the embodiment illustrated in FIG. 19, the assembly 110 is secured to the wall by a mounting member 119. The mounting member 119 can be a screw, a nail, a fastener, bracket, a bolt, or combinations thereof.

The assembly 110 may also include modular sections 110A, 110B, 110C that fit together on the wall around the body of liquid. The modular sections 110A, 110B, 110C may include connectors 120 for fitting the modular sections to each other. One or more gaskets 121 may be used between pairs of modular sections to maintain an airtight seal. In addition, the assembly 110 may include at least one wall seal 122 to maintain an airtight seal.

An exhaust connector 124 connecting the conduit 117 to an exhaust removal system is also included in the assembly 110. One end of the assembly may include an end piece 123 sealing the conduit 117.

Figure 21:
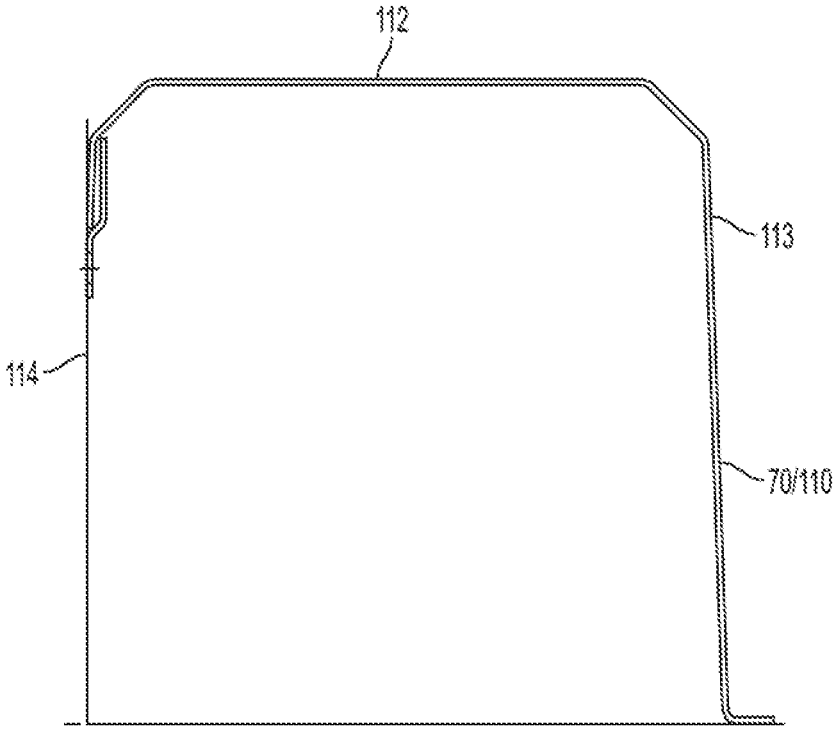
FIG. 21 is a side elevation view of the invention comprised of a side section and an integral top and side section.
Figure 22:
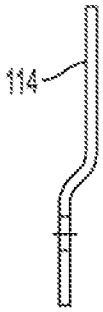
FIG. 22 is a partial enlarged view of the invention illustrating an end or edge of a side section of the invention.
Figure 24:
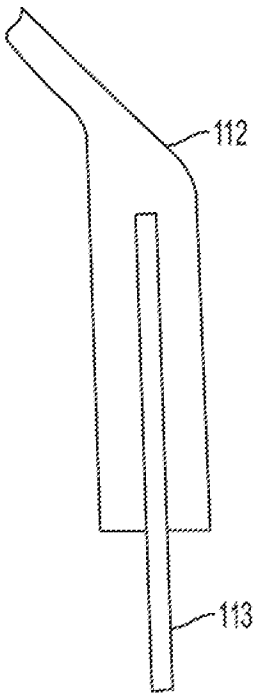
FIG. 24 is a partial enlarged view of the invention illustrating the connection between a side section and a top section of the invention.
Figure 23:
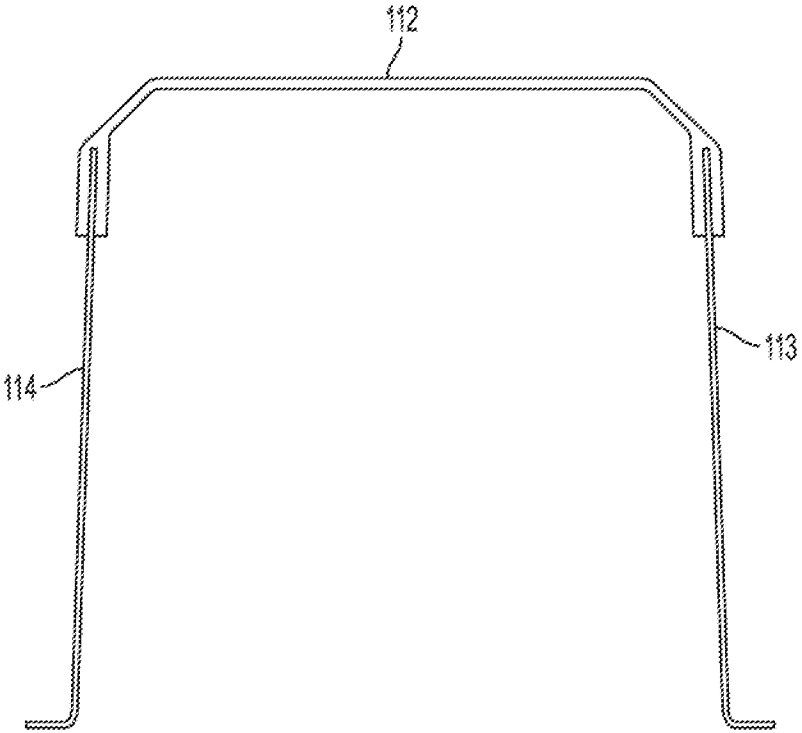
FIG. 23 is a side elevation view of the invention comprised of two separate side sections and a top section.

In another embodiment of the invention, the top section 112 and one of the side sections 113, 114 of the wall-mounted 110 or bench assembly 70 are integrally formed as illustrated in FIG. 21, such that the other side section is a separate piece. In this embodiment, at least one end of the top section 112 is releasably secured to one end of one of the side sections 113, 114. That said, the top section 112 and the side sections 113, 114 may also be formed from separate pieces, wherein the top section is releasably secured to the side sections as illustrated in FIG. 22. Accordingly, in this embodiment, opposing ends of the top section 112 are releasably secured to ends of the side sections 113, 114.

In the drawings and specification, there have been disclosed typical embodiments on the invention and, although specific terms have been employed, they have been used in a generic and descriptive sense only and not for purposes of limitation, the scope of the invention being set forth in the following claims.

That which is claimed is:

1. An apparatus for evacuating air from an area above a body of liquid and into an exhaust removal system, said apparatus comprising:

an assembly configured to connect to a vertical wall connected to a floor of a facility housing the body of liquid with said assembly spaced apart from and positioned above the body of liquid, said assembly comprising two opposing side sections connected by a top section and configured to be oriented such that said top section is both spaced apart from and parallel with the vertical wall and said side sections face each other by each extending perpendicularly to the vertical wall on opposite ends of said top section to define a conduit between the wall, said opposing side sections and said top section, wherein the conduit is unobstructed between the vertical wall and the top section, and wherein one of said side sections between the floor and other opposing side section defines at least one port below the other opposing side section such that the port is perpendicular to said one of said side sections and connected to the conduit, said port directing contaminants and water vapor from a surface of the body of liquid into said conduit;

wherein each of said side sections comprises an integral flange along an edge of the side section distal from the top section, said flange extending perpendicularly from the side section in a direction away from the conduit, and wherein each flange defines at least one opening to receive a mounting member that connects said assembly to the vertical wall of the facility housing the body of liquid; and wherein said top section and said side sections are separate pieces, and said top section is releasably secured to said side sections.

2. An apparatus according to claim 1 wherein said mounting member is a screw, a nail, a fastener, bracket, and a bolt, or combinations thereof.

3. An apparatus according to claim 1 wherein said assembly comprises modular sections that fit together on the wall around the body of liquid.

4. An apparatus according to claim 3 wherein said modular sections comprise connectors for fitting said modular sections to each other.

5. An apparatus according to claim 3, further comprising at least one gasket between pairs of modular sections.

6. An apparatus according to claim 1 further comprising an exhaust connector connected to one of said opposite ends of said top section for connecting said conduit to an exhaust removal system.

7. An apparatus according to claim 6, further comprising an end piece connected to another of said opposite ends of said top section and sealing the conduit with said end piece.

8. An apparatus according to claim 1, wherein said top section and said other opposing side section are formed without ports.

9. An apparatus according to claim 1, wherein the port is of uniform diameter.

10. A system for evacuating air from an area above a swimming pool and into an exhaust removal system, said system comprising:

a swimming pool containing water that provides contaminants and water vapor to the air in the area above the swimming pool;

a swimming pool housing containing the swimming pool, the housing having a roof above the swimming pool and a plurality of vertical walls surrounding the swimming pool;

an exhaust removal system; and an apparatus comprising:

opposing side sections connected by a top section and configured to be mounted such that said top section is both spaced apart from and facing a wall of the housing and said side sections face each other by each extending perpendicularly to the wall of the housing on opposite ends of said top section to define a conduit between the wall of the housing, said opposing side sections and said top section, wherein the conduit is unobstructed between the wall of the housing and the top section; and an exhaust connector for connecting said conduit to the exhaust removal system;

wherein at least one of said opposing side sections defines at least one port such that the port is perpendicular to said at least one of said side sections section and connected to the conduit, said at least one port being of a uniform diameter through said side section, wherein the other opposing side section has no ports and wherein said conduit is negatively pressurized by the exhaust removal system to evacuate the contaminants and water vapor from the area above the swimming pool by directing the contaminants and water vapor in a direction parallel to the surface of the water and into the conduit via the at least one port.

11. A system according to claim 10, further comprising a respective flange connected to each side section and adapted to connect the apparatus to the wall of the housing.

* * * * *